United States Patent [19]

Knapp

[11] Patent Number: 4,509,222

[45] Date of Patent: Apr. 9, 1985

[54] PIG FEATURING FOAM FILLED CAVITY

[76] Inventor: Kenneth M. Knapp, 1209 Hardy St., Houston, Tex. 77020

[21] Appl. No.: 557,370

[22] Filed: Dec. 2, 1983

[51] Int. Cl.[3] ..... B08B 9/04

[52] U.S. Cl. ..... 15/104.06 R; 166/153

[58] Field of Search ..... 15/3.5, 3.51, 104.06 R, 15/104.06 A; 137/268; 166/153, 170

[56] References Cited

U.S. PATENT DOCUMENTS

| | | | |
|---|---|---|---|
| 4,069,535 | 1/1978 | Cato | 15/104.06 A |
| 4,083,074 | 4/1978 | Curtis | 15/104.06 A |
| 4,365,379 | 12/1982 | Neff | 15/104.06 A |

*Primary Examiner*—Edward L. Roberts

*Attorney, Agent, or Firm*—Gunn, Lee & Jackson

[57] ABSTRACT

In the preferred and illustrated embodiment, an improved pig is set forth. The preferred version includes a body with a hollow cavity filled with foam. The body supports a number of encircling ribs for wiping the inside pipe surface. The internal foam filled cavity is exposed to pipeline pressure which enters through a constricted opening at the rear. In the event of a pressure surge, the fluid enters the pig with a pressure wave front, the pressure wave front being slowly propagated through the foam body. As the retarded pressure wave front moves through the body, the pig has sufficient time to move. Failure to incorporate this retardation of the propagated pressure wave front risks blowing out the nose of the pig.

7 Claims, 2 Drawing Figures

PIG FEATURING FOAM FILLED CAVITY

BACKGROUND OF THE DISCLOSURE

A pig showing an elongate body with multiple surrounding external wiping ribs is set forth in U.S. Pat. No. 4,083,074. An alternative structure is shown in U.S. Pat. No. 4,069,525. These two patents set forth pipeline pigs having an elongate body with multiple pipe wiping ribs on the exterior. The term rib is used hereinafter to refer to a peripheral lip or fin extending radially outwardly, all for the purpose of wiping the interior of the pipe. Such pigs typically have elongate bodies and are shaped in the fashion of a bullet with a streamlined nose or point. Such pigs further use multiple ribs to assure that the pipe wall is adequately wiped. Pigs of this construction are typically hollow to reduce the cost of the pig. Moreover, a hollow pig of this type is generally lighter and less likely to wear flat on the bottom side. Pig weight is a determining factor in the formation of flat spots on the wiping ribs.

There is a risk of damage in the use of such a pig. Assume that a pig is travelling along a pipeline at a specified velocity urged along the pipe by a particular fluid flow rate and pressure behind the pig. Assume further that a shock wave overtakes the pig from the rear. The shock wave will typically be accompanied by a pressure rise of between 5% and 40%. In this representative situation, the propagation velocity of the shock wave in the pipeline is quite fast. This pressure wave front typically propagates very rapidly, and can travel the length of the pig in millisecond speed. In the typical case, the pressure pulse propagates through the cavity of the pig typified in the prior art to impinge on the nose of the pig very rapidly. The nose of the pig is then forced to yield or give. While the pig may well be moving, it does not move sufficiently fast in response to the rapidly propagated pressure wave travelling along the pipeline. This typically unduly loads the nose area of the internal cavity. Often, the rapid loading will blow the front nose out of the pig. That is, the pig will be ruptured by blowing out a portion of the nose area adjacent to the cavity.

The pig of the present disclosure overcomes this handicap. The pig of this disclosure is improved to avoid such a problem and difficulty. One approach to avoidance of this problem is to simply do away with the cavity. If the cavity is sealed and hence becomes a pressurized cavity, the pressure in the cavity must be periodically adjusted. While it might be initially adjusted to match the nominal pressure in the pipeline, this is usually inadequate to accommodate pressure surges. Rather, pressure surges will shrink the pig as the compressible fluid in the cavity shrinks. This is usually an unacceptable solution. A solid pig body is an alternate solution. However, this markedly increases the weight of the pig and cost also. As the pig weight increases, there is an increased tendency to wear a flat face on the bottom of the pig, thereby destroying its circular construction and permitting leakage past the pig in the pipeline.

This improved construction overcomes these severe limitations. It provides a pipeline pig with a hollow cavity and hence a lighter pig body. The pig body cavity is filled with lightweight foam. The foam is accessed through a constricted opening in the rear of the pig to fill the cavity. After the pig body has been filled with foam, the cavity defines a lightweight body. Moreover, the foam filling the cavity markedly retards pressure shock waves travelling along the pipe. With this in view, the present apparatus is described in general terms as comprising an elongate hollow bullet shaped pig body. It has a number of peripheral ribs on it for wiping the interior of the pipe. It has a transverse cup-like rear face which is urged by the pressure gradient in the pipe. The body is hollow, and is filled with foam. A small opening or constricted passage at the rear of the body admits fluid under pressure. The restriction of the opening has the preferred form comprising a threaded plug having a relatively small orifice in it.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore now to be considered limiting of its scope, for the invention may admit to other equally effective embodiments.

DETAILED DESCRIPTION OF THE PREFERRED EMBODIMENT

Figure 1:
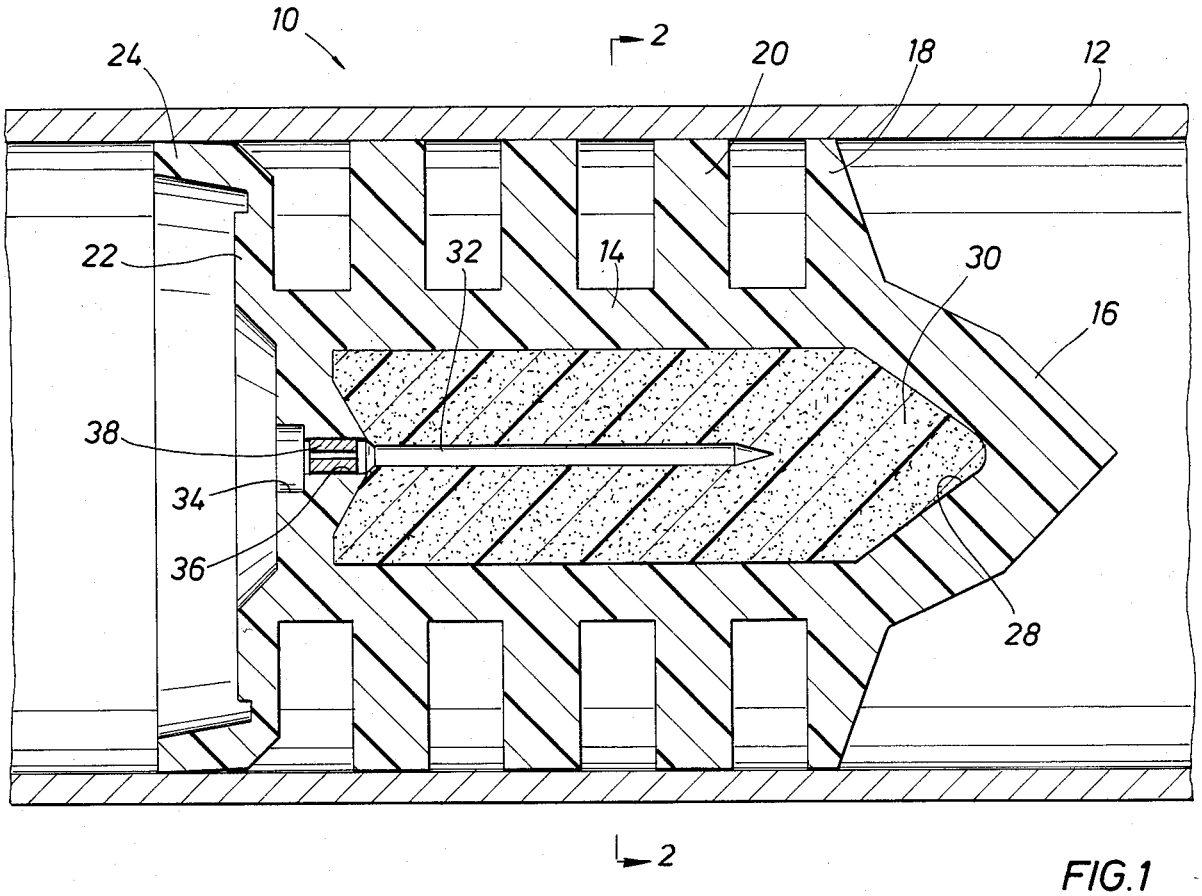
FIG. 1 is a sectional view through the improved pig of the present disclosure located in a pipeline and showing details of construction of the pig body.
Figure 2:
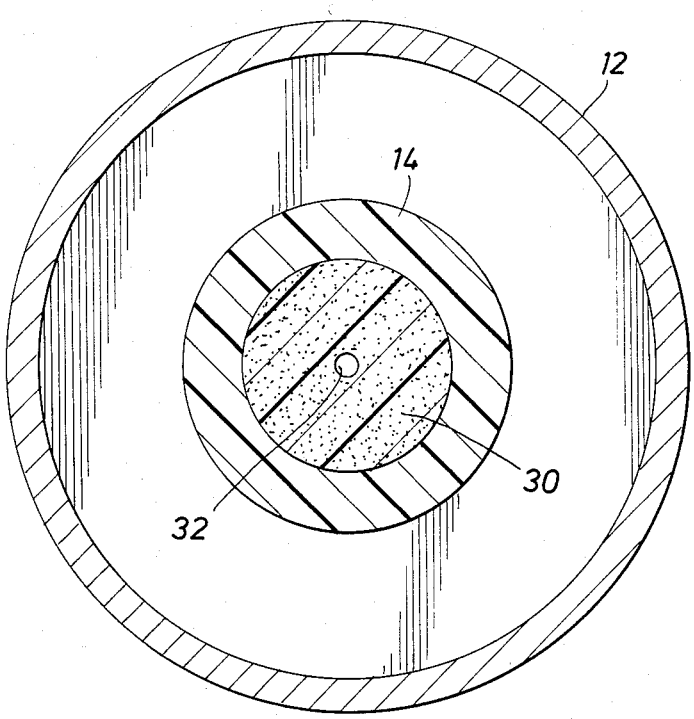
FIG. 2 is a sectional view along the line 2—2 through the pig of the present invention.

Attention is first directed to FIG. 1 of the drawings where the numeral 10 identifies the pipeline pig of the present disclosure. It is located in a pipe 12 and is adapted to travel along the pipe from left to right as viewed in FIG. 1. A pressure gradient behind the pig forces the pig along the pipe. The pipe has an interior wall which has a nominal diameter, and the pig 10 is sized to fit against the diameter. The pig body is identified by the numeral 14. The pig body terminates at a forward nose 16 which is generally a pointed shape. The pig incorporates a first, forward, surrounding, laterally constructed flange or rib 18 terminating at a lip. There is a similar and parallel rib 20. Multiple ribs are included along the length of the body. Typically, fewer than eight or nine ribs are included, these serving as wiping edges. They all preferably have a common diameter to enable them to wipe the inside of the pipe. Moreover, they are sized so that they fit snugly against the pipe to limit fluid bypass around the pig.

The rear of the pig terminates in a facing rear area 22 surrounded by a tapered lip 24. The propellant fluid in the pipeline acts against the face 22.

As described in this juncture, the shape and form of the pig fairly well resembles pigs known in the art. However, the improved pig of this disclosure is markedly different in the manner set forth below. The numeral 28 identifies an internal elongate hollow cavity in the pig. This cavity is filled with foam at 30. Typically, the foam in the cavity has a relatively light density compared with the pig body. The pig body is typically made with cast polyurethane of substantial strength. The relative hardness of the pig body requires the use of a relatively heavy polyurethane body. The body is lightened by the incorporation of the cavity 28. The cavity is filled with foam from the base area. The cavity is filled by inserting an elongate wand into the cavity to deliver the foam. As the wand is withdrawn, it leaves behind an axial passage 32 formed in the foam. This axial passage shown in FIG. 1 is sharply defined within the foam. In reality, the axially passage may be ill-defined in light of the fact that the foam material deposed in the cavity tends to fill the cavity and will flow to fill the place where the wand was previously positioned. Accordingly, the passage 32 is somewhat exaggerated in definition. Such a passage may be observed on inspecting the foam but it is, in general terms, less of a passage and more of an irregular pathway through the foam. It is important to note that the passage does not need to extend fully through the foam in the cavity; rather, the passage 32 has a depth of about 50–75% of the length of the cavity. The foam has a density ranging typically from six to about fifteen pounds per cubic foot. This range is typical of and provides suitable structural integrity. Foam excessively light will not hold up and foam excessively heavy is too expensive.

A recessed opening 34 is shown in the transverse wall which terminates the back of the pig. The cavity 28 centers around an opening 36. The opening 36 is shown in FIG. 1 to be a threaded area. Typically, it is intended to receive a threaded sleeve. Threads are not necessarily formed in the polyurethane which surrounds this opening; rather, the polyurethane accepts a threaded member which bites into the foam, thereby enabling the opening to secure the threaded member. Moroever, the numeral 38 identifies a threaded member placed in the opening at 36. The threaded member preferably has external threads which grip and engage the surrounding body. It has a narrow orifice or passage. This orifice opens into the hollow cavity 28 within the body from the exterior. The narrow passage serves as a restriction to flow. It is a restriction which materially limits the pressure wave propagation in the fluid under pressure into the cavity. Perhaps this will be understood better on review of the device in operation.

Assume that the pig of the present disclosure is placed in a pipeline having a nominal flow rate and pressure well within limits. As an example, assume that the velocity or flow rate in the pipeline requires the pig to travel at a rate of 300 feet per minute. Assume further that the driving force of the fluid acting against the pig is a nominal 500 psi. While this will be the pressure behind the pig, there will be a small pressure drop across the pig. The typical pressure drop is normally relatively small. Assume further that the fluid in the pipeline does fill the cavity 28. That is, the cavity is filled with the fluid at the pressure observed behind the pig. Thus, if the drop across the pig is 10 psi, the pressure in the cavity, will exceed the pressure at the nose of the pig by 10 psi or more.

Assume that a pressure urge is propagated along the pipeline from behind the pig. Such a surge might arise from any cause as, for example, slamming of a valve upstream of the pig. Such pressure surges will typically be propagated through the pig at millisecond speed. That is, the surge will travel into the cavity 28 and be observed at the front end of the cavity only a fraction of a second after it is observed at the back of the pig. Assume that the pressure surge is a peak of 250 psi above the normal pressure in the pipeline. When this pressure surge acts on the back face of the pig, it tends to boost the pig velocity but there is a delay to overcome inertia. Further, the back of the pig is retarded because it cannot speed up, pushing the front of the pig. In fact, the back of the pig cannot be compressed readily to speed up the front of the pig. This requires therefore that the pig accelerate to a new velocity, and such acceleration requires a few milliseconds, or perhaps even longer. While the time is not critical, it is important to note that the pressure surge which impacts the pig from the rear is propagated past the pig long before the pig is able to speed up and thereby relieve the pressure surge by moving more rapidly. This is not so for the nose area of the cavity 28.

Recall that the cavity is filled with fluid at the nominal pressure observed in the pipeline. The pressure surge will act on the nose of the pig through the cavity 28, hammering against the nose. It is possible to impinge on the nose so vigorously that a tearing force around the nose is created. Thus, when the pressure surge is observed instantly at the nose area of the cavity 28, the surge tends to punch a hole in the nose by forcing the nose excessively to the right of FIG. 1. This typically leads to catastrophic failure by punching out the nose, thereby damaging the pig. This is especially true with a pressure surge of rather sharp definition. When the surge is propagated through the pig, the nose is forced to move quickly in response to the pressure wave passing through the pig; thus, the nose will be forced by pressure differential across the nose to speed up, stretching the nose and tending to tear it away. Since the pressure shock wave is propagated at high velocity along the pipe 12, such failures can occur readily even if the differential pressure peak is relatively small.

The present apparatus retards the pressure shock wave passing through the cavity. First of all, it is retarded by the relatively small orifice in the fitting 38. That is, high velocity flow into the cavity is not permitted. Such pressure surge will be retarded by a few milliseconds and hence delayed in arrival at the nose. Moreover, the preferred embodiment retards the pressure wave as it is propagated through the cell structure of the foam. This again slows down the pressure wave: not only does it slow it down, but it also stretches out the pressure shock wave so that the gradient takes several milliseconds to arrive at the nose area. This tends to reduce the peak amplitude of the transient. Also, it avoids the tearing which may occur, permitting greater time to pass and hence enabling the pig to move after the pressure peak build-up has been observed at the rear of the pig.

While the foregoing is directed by the preferred embodiment, many alterations and variations can be made without departing from the scope of the claims of this apparatus.

What is claimed is:

1. A pipeline pig sized for placement in a pipeline flowing a fluid therealong in response to a pressure gradient acting on the fluid from an upstream location, and wherein the pig is carried with the flow of fluid in the pipeline, the pig comprising:

(a) an elongated pig body having a nose and having a centrally located hollow cavity therein of specified length and diameter;

(b) annular flexible rib means surrounding said body and extending radially outwardly therefrom to contact the inside surface of a pipeline wherein said rib means wipes the inside surface of the pipeline;

(c) a transversely extending rearwardly locating face on said body extending toward the surrounding pipe for intercepting fluid flowing in the pipeline to impart a force to the pig for moving the pig;

(d) passage means through said face into the cavity in said body, said passage means exposing said cavity to fluid in the pipeline from behind the pig; and (e) retarding means having the form of foamed plastic in said cavity for retarding the velocity of propagation of pressure surges from behind the pig into said cavity from said passage means and wherein said retarding means enables fluid from behind the pig to impinge on the nose portion of said cavity delayed such that pressure shock waves propagated along the pipe from behind the pig are retarded by said retarding means.

2. The apparatus of claim 1 wherein said retarding means comprises a constricted orifice restricting the rate of flow of fluid into and out of said cavity.

3. The apparatus of claim 1 wherein said retarding means further includes a constricted orifice in said passage means.

4. The apparatus of claim 3 wherein said orifice comprises a threaded sleeve in said passage having a hole therethrough.

5. The apparatus of claim 4 wherein said sleeve further includes threads thereon for joining the said pig body.

6. The apparatus of claim 5 wherein said foamed plastic material comprises a foam filling said cavity from said passage means.

7. The apparatus of claim 1 wherein said rib means are integrally cast with said pig body.

* * * * *